US011664617B2

(12) United States Patent
Li et al.

(10) Patent No.: US 11,664,617 B2
(45) Date of Patent: May 30, 2023

(54) ELECTRICAL TERMINAL, METHOD FOR MANUFACTURING ELASTIC TERMINAL, ELECTRICAL CONNECTOR AND ELECTRONIC DEVICE

(71) Applicant: Tyco Electronics (Shanghai) Co. Ltd., Shanghai (CN)

(72) Inventors: Hua Li, Shanghai (CN); Guangming Zhao, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 36 days.

(21) Appl. No.: 17/237,196

(22) Filed: Apr. 22, 2021

(65) Prior Publication Data

US 2021/0336364 A1 Oct. 28, 2021

(30) Foreign Application Priority Data

Apr. 22, 2020 (CN) ..... 202010324765.6

(51) Int. Cl.
*H01R 13/11* (2006.01)
*H01R 43/20* (2006.01)
*H01R 43/16* (2006.01)

(52) U.S. Cl.
CPC ..... *H01R 13/111* (2013.01); *H01R 43/16* (2013.01); *H01R 43/20* (2013.01)

(58) Field of Classification Search
CPC ..... H01R 13/11; H01R 43/16; H01R 43/20; H01R 13/111
USPC ..... 439/743
See application file for complete search history.

(56) References Cited

FOREIGN PATENT DOCUMENTS

| | | | | |
|---|---|---|---|---|
| CN | 104319495 B | * | 3/2017 | |
| CN | 106654652 A | * | 5/2017 | ..... H01R 13/02 |
| CN | 106654727 A | * | 5/2017 | |
| CN | 106816740 A | * | 6/2017 | |
| CN | 107658600 A | * | 2/2018 | ..... H01R 13/15 |
| CN | 109193219 A | * | 1/2019 | |
| CN | 107658600 B | * | 6/2019 | ..... H01R 13/15 |
| CN | 107528149 B | * | 7/2019 | ..... H01R 13/187 |
| CN | 107565251 B | * | 7/2019 | |
| CN | 107819225 B | * | 10/2019 | ..... H01R 13/11 |
| WO | WO-2011021298 A1 | * | 2/2011 | ..... H01R 13/111 |

* cited by examiner

*Primary Examiner* — Peter G Leigh
(74) *Attorney, Agent, or Firm* — Barley Snyder

(57) ABSTRACT

An elastic terminal includes a first base having an annular shape and a plurality of elastic sheets extending from the first base in an axial direction. A slit is formed between a pair of adjacent elastic sheets. The plurality of elastic sheets include a plurality of sets of elastic sheets, each elastic sheet of each set of elastic sheets has a plurality of electrical contact portions protruding inwardly radially. The electrical contact portions of one set of elastic sheets are arranged on a same circumference and the electrical contact portions of different sets of elastic sheets are staggered with respect to each other in the axial direction.

18 Claims, 23 Drawing Sheets

ELECTRICAL TERMINAL, METHOD FOR MANUFACTURING ELASTIC TERMINAL, ELECTRICAL CONNECTOR AND ELECTRONIC DEVICE

CROSS-REFERENCE TO RELATED APPLICATION

This application claims the benefit of the filing date under 35 U.S.C. § 119(a)-(d) of Chinese Patent Application No. 202010324765.6, filed on Apr. 22, 2020.

FIELD OF THE INVENTION

The present invention relates to an electrical terminal and, more particularly, to an electrical terminal having a plurality of elastic sheets.

BACKGROUND

A socket-type electrical connector is adapted receive an insertion of a pin-type mating terminal. The mating terminal may be inserted into the electrical connector to be electrically connected with an elastic terminal in the electrical connector. The electrical connector has a generally cylindrical outer profile, and is adapted to be fixed and electrically connected onto a circuit board, so as to realize an electrical connection between a wire connected to the mating terminal and the circuit board.

During an operation, the mating terminal may float relative to the electrical connector due to an interference of external factors such as a vibration, which may cause an electrical connection between the mating terminal and the electrical connector to fail, and sometimes even damage the mating terminal and/or the electrical connector. The elastic terminal of the existing electrical connector has limited electrical contact portions in number, which may result in large body resistance and a contact resistance of the elastic terminal as well as a relatively large insertion force when inserting the elastic terminal of the mating terminal.

SUMMARY

An elastic terminal includes a first base having an annular shape and a plurality of elastic sheets extending from the first base in an axial direction. A slit is formed between a pair of adjacent elastic sheets. The plurality of elastic sheets include a plurality of sets of elastic sheets, each elastic sheet of each set of elastic sheets has a plurality of electrical contact portions protruding inwardly radially. The electrical contact portions of one set of elastic sheets are arranged on a same circumference and the electrical contact portions of different sets of elastic sheets are staggered with respect to each other in the axial direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
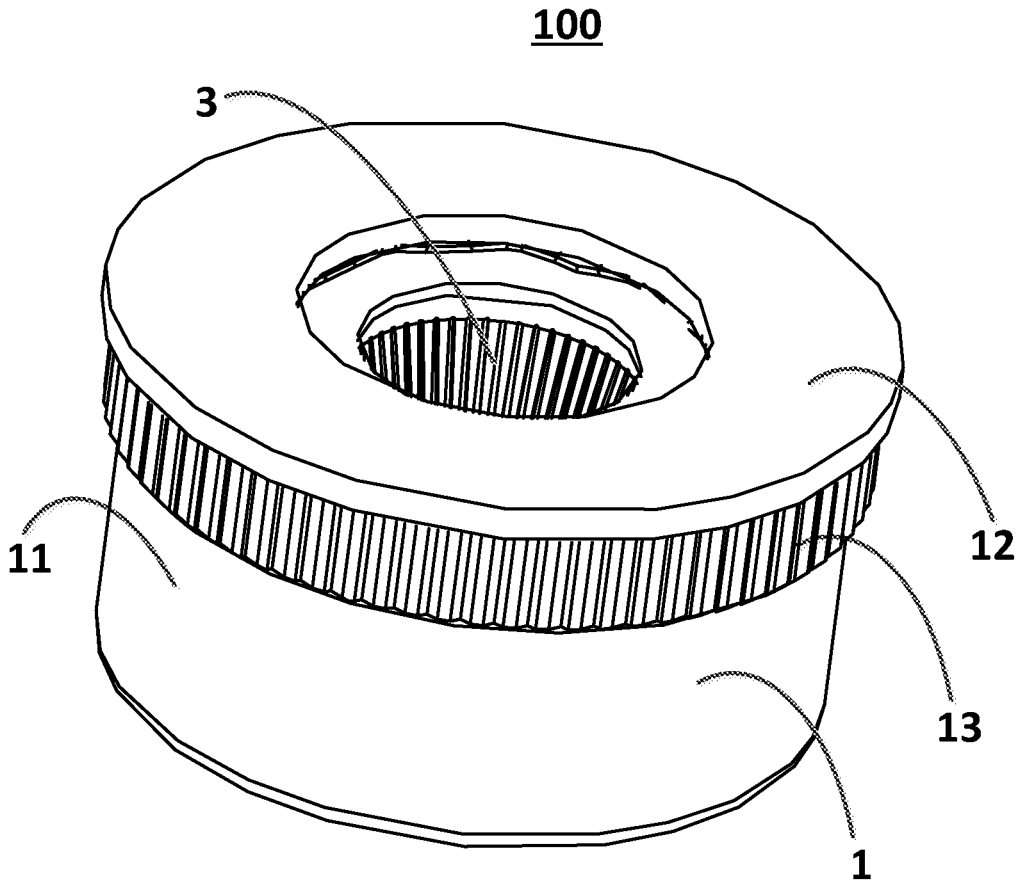
FIG. 1 is a perspective view of an electrical connector according to an embodiment.

The technical solution of the disclosure will be described hereinafter in further detail with reference to the following embodiments, taken in conjunction with the accompanying drawings. In the description, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
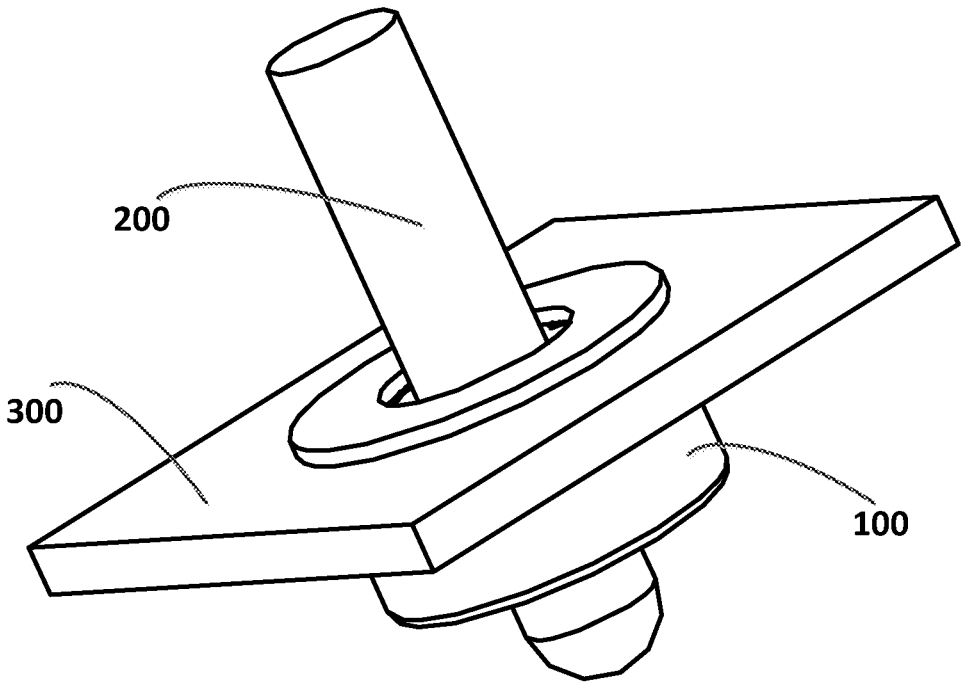
FIG. 2 is a perspective view of the electrical connector of FIG. 1 connected with a mating terminal.
Figure 3:
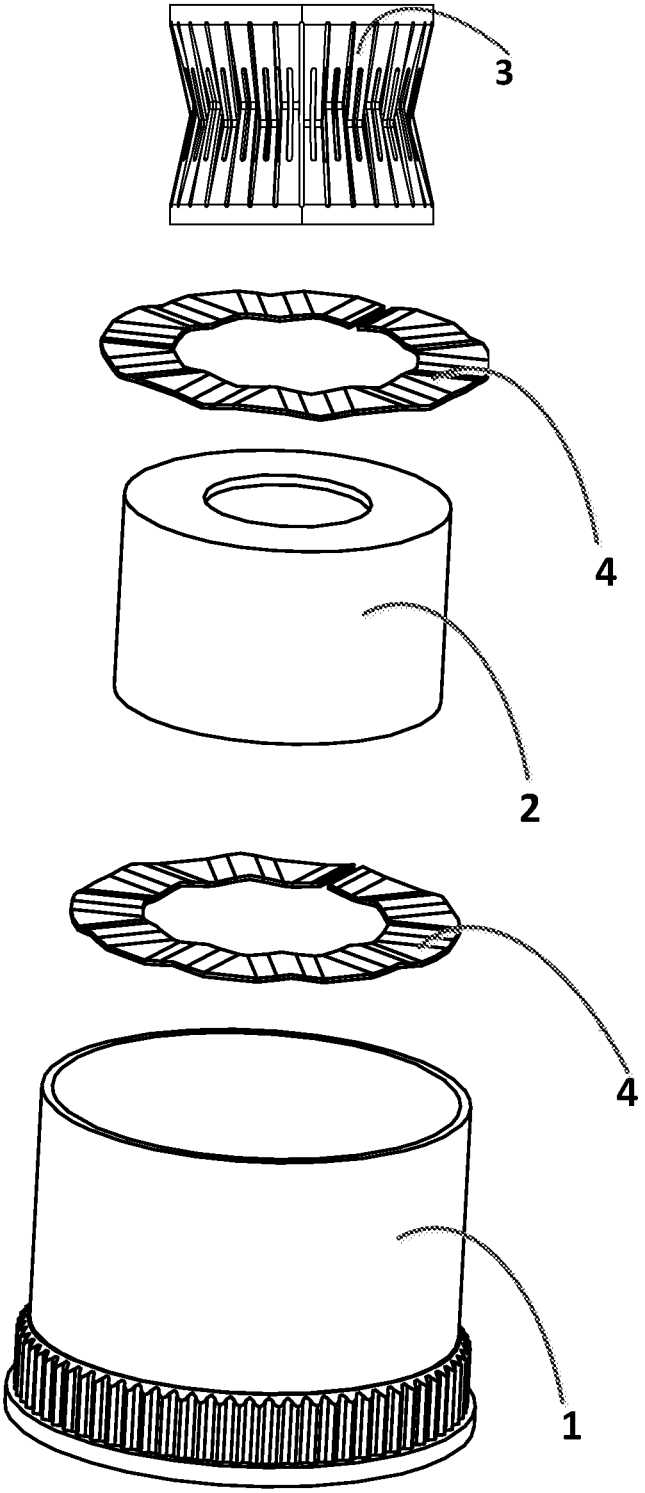
FIG. 3 is an exploded perspective view of the electrical connector of FIG. 1.

As shown in FIGS. 1 to 3, in an exemplary embodiment of the disclosure, an electrical connector 100 is adapted to be electrically connected with a plug-type mating terminal 200, and includes an outer housing 1, an inner housing 2, and an elastic terminal 3.

Figure 4:
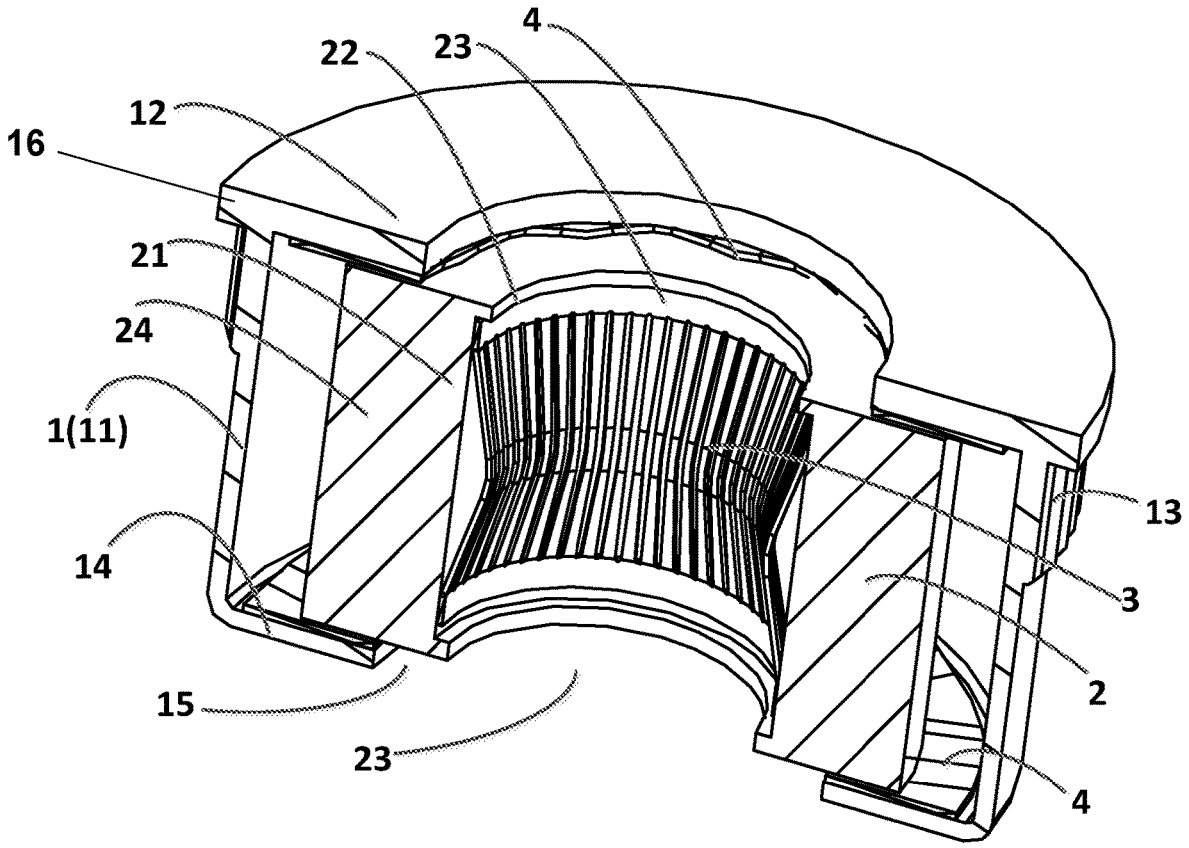
FIG. 4 is a sectional perspective view of the electrical connector of FIG. 1.
Figure 5:
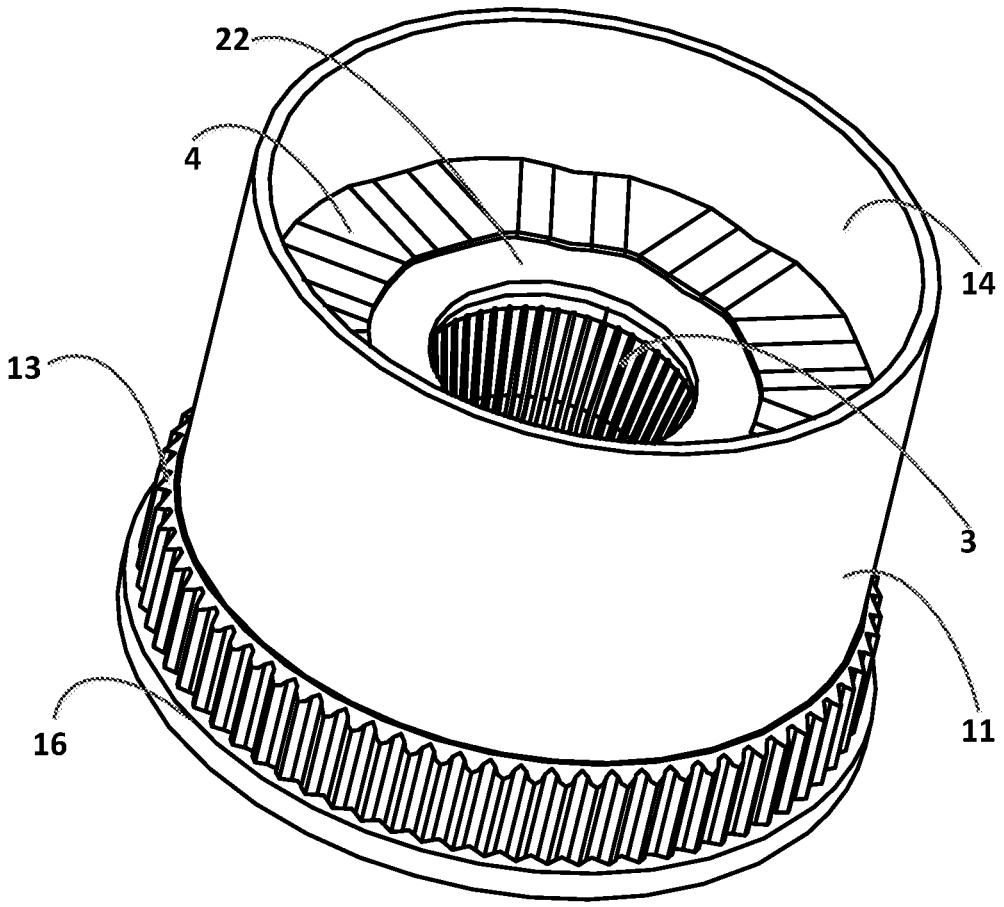
FIG. 5 is a perspective view of the electrical connector of FIG. 1 in a state in which a lower blocking disc of an outer housing is not bent.
Figure 6:
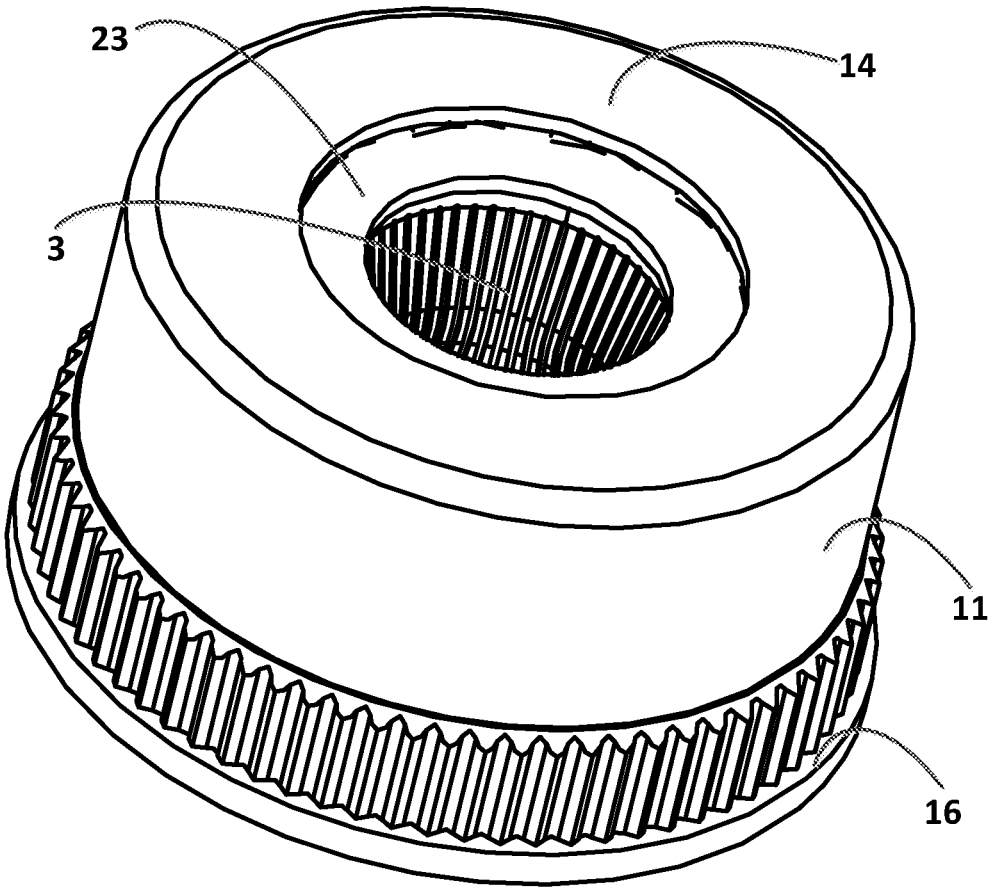
FIG. 6 is a perspective view of the electrical connector of FIG. 1 in a state in which the lower blocking disc of an outer housing is bent.

In an exemplary embodiment of the disclosure, as shown in FIGS. 1 to 4, the outer housing 1 includes an outer cylinder 11, and an upper blocking disc 12 and a lower blocking disc 14 radially inwardly extending from both ends of the outer cylinder 11. The upper blocking disc 12 is formed with an outer through hole 15. The inner housing 2 includes an inner cylinder 21 and a mounting portion 24 surrounding the inner cylinder 21 and integrally formed around the inner cylinder 21. The mounting portion 24 is movably mounted in a space defined by the outer cylinder 11, the upper blocking disc 12, and the lower blocking disc 14. As shown in FIG. 4, the inner housing 2 is formed with an inner through hole 23. The elastic terminal 3 is mounted in the inner cylinder 21 and is configured to be electrically connected with the mating terminal 200 inserted into the inner cylinder 21 through the outer through hole 15 of the outer housing 1.

The electrical connector 100 according to an exemplary embodiment of the disclosure further includes an elastic mechanism 4 mounted between the outer housing 1 and the inner housing 2, as shown in FIGS. 3 and 4. The inner housing 2 is movable relative to the outer housing 1 against an elastic force of the elastic mechanism 4. Since the inner housing 2 is movable relative to the outer housing 1 against the elastic force of the elastic mechanism 4, the mating terminal 200 mounted in the elastic terminal 3 is allowed to move relative to the outer housing 1 together with the elastic terminal 3 to realize a floating electrical connection between the mating terminal 200 and the electrical connector 100.

As shown in FIGS. 1 to 6, in an exemplary embodiment of the disclosure, the lower blocking disc 14 is formed by bending inwardly radially after the inner housing 2 and the elastic mechanism 4 are assembled into the outer housing 1. In this way, a holding force of the lower blocking disc 14 to the inner housing 2 may be increased, and an overall structure of the electrical connector 100 may be simplified. In addition, the upper blocking disc 12 and the outer cylinder 11 may be manufactured at one time through a stamping process, for example.

In an exemplary embodiment of the disclosure, the electrical connector 100 may comprise a circular connector and have a generally cylindrical outer profile. Each of the outer housing 1, the inner housing 2 and the elastic mechanism 4 is made of a conductive material such as copper, such that the mating terminal 200 is in electrical communication with the outer housing 1. In this way, the outer housing 1 may be directly electrically connected onto a circuit board 300 to realize an electrical connection between the mating terminal 200 and the circuit board 300.

In an exemplary embodiment of the disclosure, the mounting portion 24 has the same height as that of the inner cylinder 21. That is, as shown in FIG. 4, a side wall of the inner housing 2 has a uniform thickness over the entire height of the inner housing 2. The mounting portion 24 is integrally formed on an outer surface of the inner cylinder 21 over the entire height thereof, and the outer housing 1 has a height greater than the maximum height of the inner housing 2. The upper blocking disc 12 further extends radially outwardly to form a flange portion 16. A portion of the outer cylinder 11 proximate to the flange portion 16 is formed as a widened portion protruding radially outwardly. The circuit board 300, shown in FIG. 2, formed with a mounting hole or a copper terminal block may be mounted on the widened portion against the flange portion 16 through a welding or crimping process, so that the electrical connector 100 is firmly mounted on the circuit board 300. Furthermore, the widened portion is formed with a serration portion 13 such that the electrical connector 100 is further firmly mounted on the circuit board.

In an exemplary embodiment shown in FIGS. 3 and 4, the electrical connector 100 includes two elastic mechanism 4 provided between the upper blocking disc 12 and one end of the inner housing 2 in an axial direction of the electrical connector 100, and the lower blocking disc 14 and the other end of the inner housing 2, respectively. The inner housing 2 is movable relative to the outer housing 1 against the elastic force of the elastic mechanisms 4 in the axial direction. After an axial external force exerted on the inner housing 2 is removed, the elastic mechanisms 4 may drive the inner housing 2 to return back to an initial position thereof. Each of the elastic mechanisms 4 is formed as an annular elastic sheet formed into a wave shape in a circumferential direction thereof to increase an elasticity of the elastic mechanisms 4.

As shown in FIGS. 3 to 7, in an exemplary embodiment of the disclosure, the inner cylinder 2 is provided with blocking flanges 22 extending radially inwardly on both ends thereof. The blocking flanges 22 have an annular shape and are configured to define the inner through hole 23. The elastic terminal 3 includes an elastic cylinder formed by crimping a single metal sheet. The blocking flanges 22 of the inner cylinder 21 of the inner housing 2 are constructed to restrict both ends of the elastic cylinder within the inner cylinder 21, such that the elastic mechanism 4 cannot be separated from the inner cylinder 2.

As shown in FIGS. 7 to 11, in an exemplary embodiment of the disclosure, the elastic terminal 3 has a generally cylindrical shape. The elastic terminal 3 includes a generally annular first base 33 and a plurality of elastic sheets 31, 32 extending from the first base 33 in the axial direction. Furthermore, a slit 36 is formed between two adjacent elastic sheets 31 and 32. The plurality of elastic sheets 31, 32 include a plurality of sets of elastic sheets. Each set of elastic sheets has a plurality of first electrical contact portions 311 or a plurality of second electrical contact portions 321 protruding inwardly radially. The electrical contact portions of the same set of elastic sheets are substantially arranged on the same circumference, and the electrical contact portions of different sets of elastic sheets are staggered with each other in the axial direction.

Referring to FIGS. 1 and 7 to 11, since the electrical contact portions 311, 321 of different sets of elastic sheets 31, 32 of the elastic terminal 3 are staggered with each other in the axial direction, the mating terminal 200 will be sequentially brought into contact with the electrical contact portions 311, 321 of the elastic terminal 3 arranged on different circumferences during an insertion of the mating terminal 200 into the electrical connector 100. Therefore, an force for inserting the mating terminal 200 may be reduced.

As shown in FIGS. 7 to 11, in an exemplary embodiment of the disclosure, the plurality of sets of elastic sheets include a plurality of first elastic sheets 31 and a plurality of second elastic sheets 32 alternately arranged in the circumferential direction. Further, the first electrical contact portions 311 and the second electrical contact portions 321 are arranged on the whole circumference of the elastic terminal 3. When the mating terminal 200 is inserted into the elastic terminal 3 in the axial direction, the first electrical contact portions 311 and the second electrical contact portions 321 are sequentially compressed and elastically contracted to be brought in elastic contact with the inserted mating terminal 200. Therefore, a compressing force applied to the mating terminal 200 may be evenly distributed while reducing the insertion force, thereby maintaining an electrical contact performance between the mating terminal 200 and the elastic terminal 3.

Figure 11:
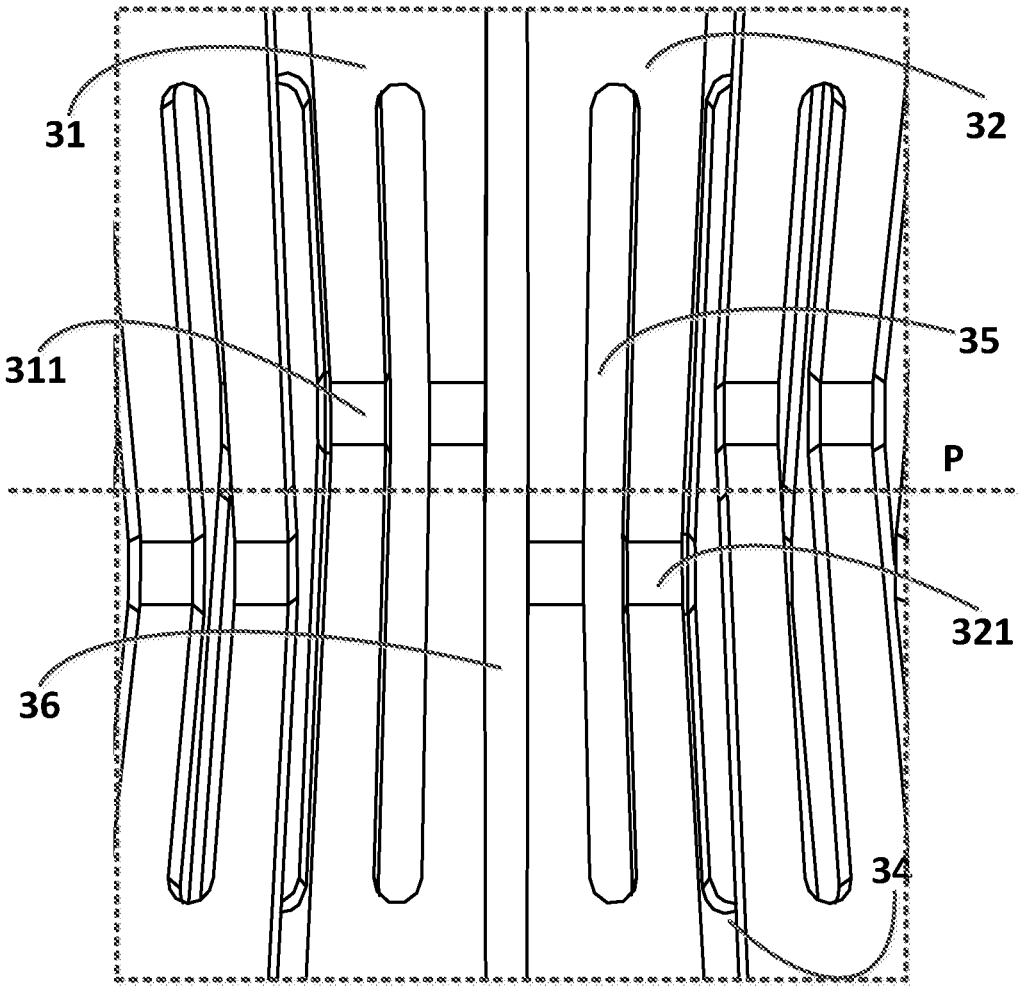
FIG. 11 is an enlarged view of a part A of FIG. 10.

In an exemplary embodiment of the disclosure, a circumference on which the first electrical contact portions 311 of the plurality of first elastic sheets 31 are arranged is symmetrical with a circumference on which the second electrical contact portions 321 of the plurality of second elastic sheets 32 are arranged with respect to a middle cross sectional plane P of the elastic sheets 31, 32 in the axial direction, shown in FIG. 11.

In an exemplary embodiment of the disclosure, shown in FIG. 11, each of the elastic sheets 31, 32 is formed with a slot 35 extending in the axial direction, and the electrical contact portions 311, 321 are located at both sides of the slot 35. In this way, the force for inserting the mating terminal 200 may be further reduced while increasing contacts of the elastic sheets 31, 32 with the mating terminal 200. Since all of the contacts are electrically connected with each other in parallel, a contact resistance between the mating terminal 200 and the elastic terminal 3 may be reduced.

Figure 9:
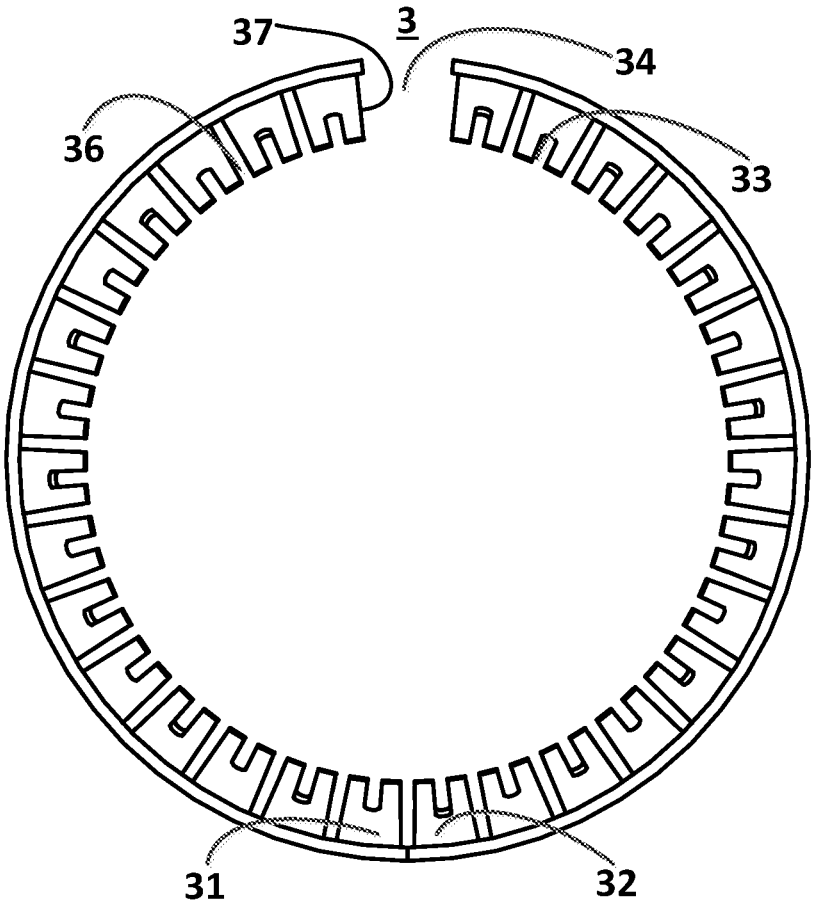
FIG. 9 is a top view of the elastic terminal of FIG. 7.

In an exemplary embodiment of the disclosure, the elastic terminal 3 is formed through a crimping process. When the elastic terminal 3 is in a free state, a gap 34, shown in FIG. 9, is formed between both edges 37 of the elastic terminal 3 to be crimped to allow the elastic terminal 3 to expand and contract radially inwardly when mounted in the inner cylinder 21. In an exemplary embodiment of the disclosure, when the elastic terminal 3 is not mounted in the inner cylinder 21, the elastic terminal 3 has a maximum outer diameter greater than an inner diameter of the inner cylinder 21. In this way, when mounted in the inner housing 2, the elastic terminal 3 is elastically contracted radially such that the both ends 37 of the elastic terminal 3 may be elastically pressed against an inner wall of the inner cylinder 21. Further, the elastic terminal 3 is reliably held in the inner housing 2 due to the blocking flanges 22 shown in FIG. 4. In an alternative embodiment, the opposite ends of the elastic cylinder 31 may be overlapped with each other.

In an exemplary embodiment of the disclosure, each of the electrical contact portions 311, 321 is formed as a vertex portion when each elastic sheet 31, 32 is bent inwardly radially. That is, the elastic sheet 31, 32 is bent with each electrical contact portion 311, 321 as a vertex. Further, each of the electrical contact portions 311, 321 has a generally arc-shaped contact surface protruding inwardly radially to be brought into smooth contact with the mating terminal 200. In an exemplary embodiment of the disclosure, the circumferences where the contact portions 311, 321 of all of the elastic sheets 31, 32 are arranged have the substantially same inner diameter, so that the first elastic sheets 31 and the second elastic sheets 32 may apply the same elastic force to the mating terminal 200.

Figure 7:
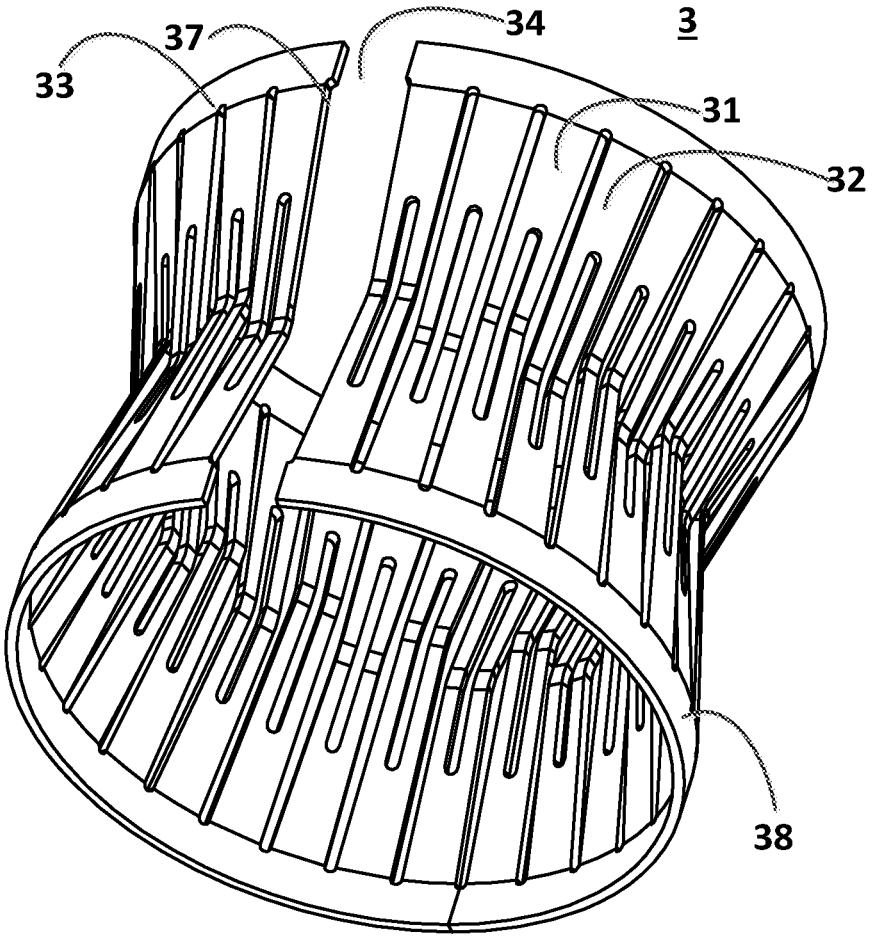
FIG. 7 is a perspective view of an elastic terminal according to an embodiment.
Figure 8:
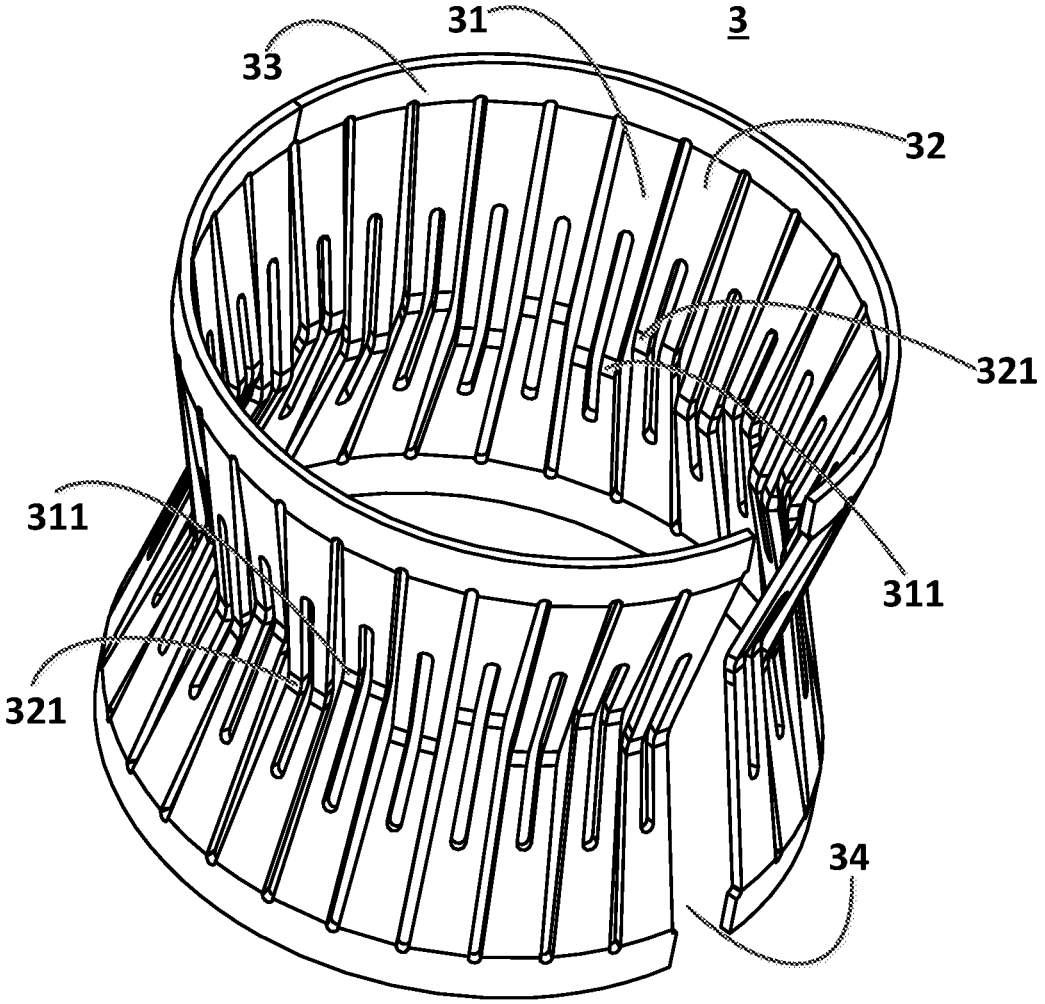
FIG. 8 is another perspective view of the elastic terminal of FIG. 7.

In an exemplary embodiment of the disclosure, as shown in FIG. 7, the elastic terminal 3 further includes an annular second base 38 to which an end of each elastic sheet 31, 32 opposite to the first base 33 is integrally connected.

Figure 12:
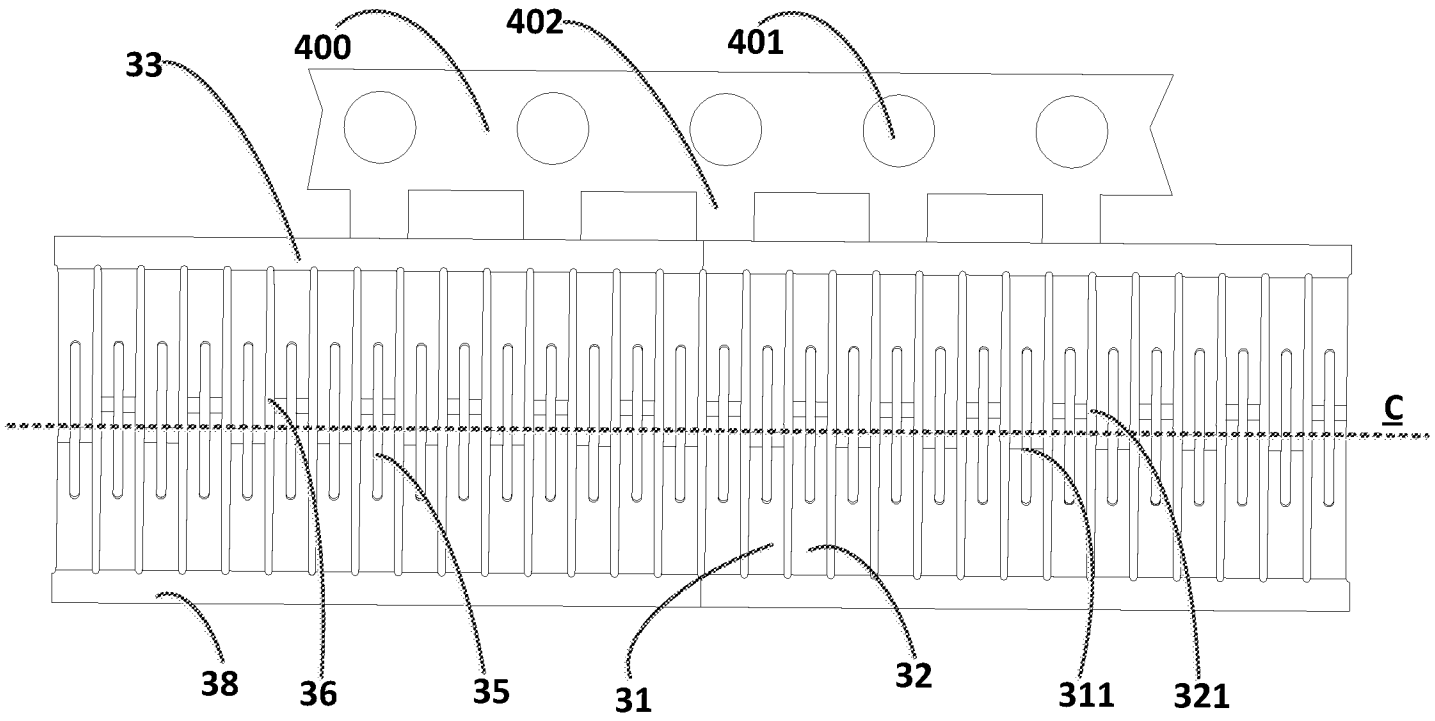
FIG. 12 is a plan view of the elastic terminal of FIG. 7 during manufacture.

Referring to FIGS. 7 and 12, according to another embodiment of the disclosure, there is provided a method for manufacturing the elastic terminal 3 as described in the above embodiments including:

step S100: stamping the plurality of elastic sheets 31, 32 extending in parallel in a first direction from a single flat metal sheet, as shown in FIG. 12, an end of each elastic sheet 31, 32 being connected to the first base 33, and the slit 36 being formed between two adjacent elastic sheets 31 and 32, so that each of the elastic sheets 31, 32 may independently apply an elastic pressure to the mating terminal 200;

step S200: dividing the elastic sheets 31, 32 into a plurality of sets of elastic sheets and forming the plurality of first electrical contact portions 311 or the plurality of the second electrical contact portions 321 on each elastic sheet 31, 32 of each set of elastic sheets, the electrical contact portions 311, 321 of the same set of elastic sheets 31, 32 being arranged in a row in a second direction perpendicular to the first direction, and the electrical contact portions 311, 321 of different sets of elastic sheets 31, 32 being staggered with each other in the first direction;

step S300: bending each of the elastic sheets 31, 32 at each electrical contact portion 311, 321 in a third direction perpendicular to the first direction and the second direction; and step S400: bending the first base 33 into a generally annular shape, such that the contact portions 311, 321 of the same set of elastic sheets 31, 32 are arranged on the same circumference, the electrical contact portions 311, 321 of different sets of elastic sheets 31, 32 are staggered with each other in the first direction, and all of the electrical contact portions 311, 321 protrude inwardly radially, thereby forming the elastic terminal 3 having the generally cylindrical shape as shown in FIG. 7.

As shown in FIGS. 7 and 12, in an exemplary embodiment of the disclosure, the plurality of sets of elastic sheets include the plurality of first elastic sheets 31 and the plurality of second elastic sheets 32 arranged alternately in the circumferential direction of the elastic terminal 3. In the step S200, the first electrical contact portions 311 and the second electrical contact portions 321 each having the generally arc-shaped contact surface are formed through the stamping process so as to ensure a smooth contact between the elastic terminal 3 and the mating terminal 200.

As shown in FIGS. 7, 11 and 12, in an exemplary embodiment of the disclosure, in the step S200, each of the first electrical contact portions 311 of the plurality of first elastic sheets 31 is offset from a center line C of the respective elastic sheet 31 in the second direction by the substantially same distance as each of the second electrical contact portions 321 of the plurality of second elastic sheets 32. In this way, during forming the elastic terminal 3, the circumference, on which the first electrical contact portions 311 of the plurality of first elastic sheets 31 are arranged, is symmetrical with the circumference, on which the second electrical contact portions 321 of the plurality of second elastic sheets 32 are arranged, with respect to the middle cross sectional plane P of the elastic sheets in the first direction.

As shown in FIGS. 7, 11 and 12, the step S100 further includes forming a slot 35 extending in the first direction in each of the elastic sheets 31, 32. In the step S400, after bending the first base 33 into the generally annular shape, the gap 34 is formed between both edges 37 of the elastic terminal 3 to be crimped.

As shown in FIGS. 7, 11 and 12, in the step S100, the end of each elastic sheet 31, 32 opposite to the first base 33 is integrally connected to the second base 38. In this way, it is convenient to perform punching, bending and other operations on each of the elastic sheets 31, 32 and all of the elastic sheets 31, 32 are evenly stressed.

In an exemplary embodiment of the disclosure, the metal sheet is made of copper-nickel material to reduce manufacturing cost of the elastic terminal 3. In the step S200, after forming the electrical contact portions 311, 321, an electroplating layer is electroplated on a surface of the elastic terminal 3 in a flat state, and the electroplating layer has an electrical conductivity greater than that of the metal sheet. For example, the electroplating layer includes beryllium copper material, thus an electrical conductivity of the elastic terminal 3 may be increased so as to reduce the contact resistance between the elastic terminal 3 and the mating terminal 200. In this way, the electrical connector 100 has good electrical conductivity and mechanical properties. After the electroplating process is completed in the step S200, a crimping process is performed in the step S300.

As shown in FIGS. 7, 11 and 12, in an exemplary embodiment of the disclosure, a plurality of elastic terminals 3 may be continuously manufactured from a piece of strip-shaped metal sheet. Before the step S100 is performed, a positioning hole 401 may be formed in a side portion 400 of the strip-shaped metal sheet. Then, the metal sheet is fixed in the positioning hole 401 by a mold before performing the step S100.

In an exemplary embodiment of the disclosure, a discontinuous connection portion 402 may be formed between the side portion 400 and the first base 33 of the elastic terminal 3 to facilitate cutting the connecting portion 402.

Figure 13:
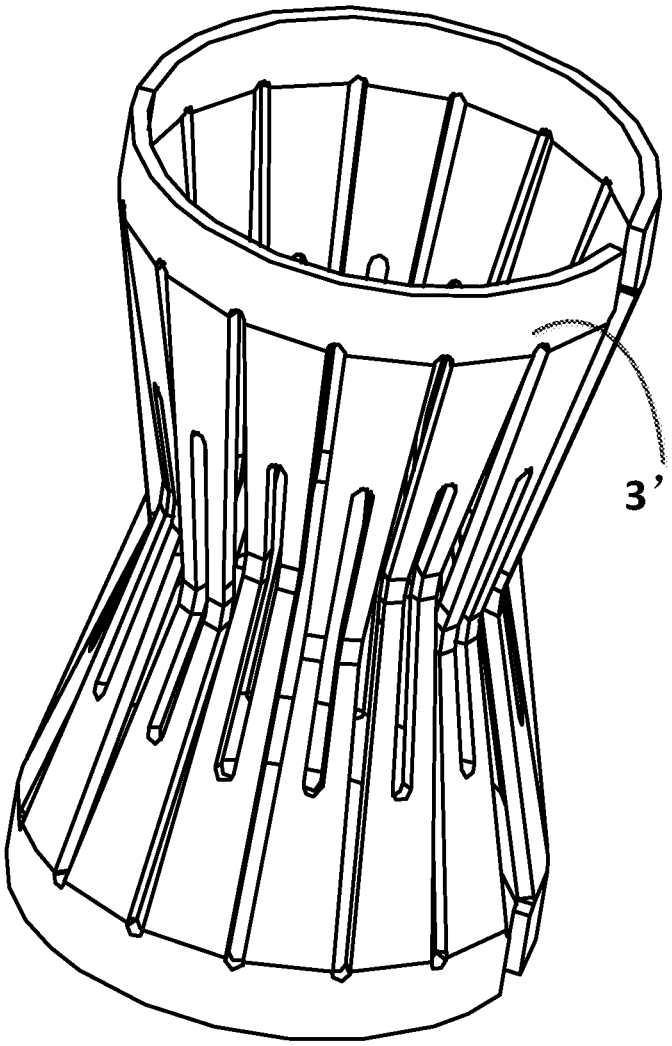
FIG. 13 is a perspective view of an elastic terminal according to another embodiment.

In the method for manufacturing the elastic terminal according to the embodiments of the disclosure, a minimum diameter of the elastic terminal may be changed based on an outer diameter of the mating terminal 200. For example, as shown in FIG. 13, the minimum diameter of the elastic terminal 3' is less than that of the elastic terminal 3 shown in FIG. 7.

In an exemplary embodiment of the disclosure, as shown in FIGS. 1 to 6, in the electrical connector 100, an inner diameter of the inner through hole 23 is less than that of the outer through hole 15, and the inner through hole 23 is located in the outer through hole 15 in a state where the inner cylinder 21 occurs a maximum floating relative to the outer housing 1 in a radial direction. In this way, even in the case where the inner cylinder 21 occurs the maximum floating relative to the outer housing 1 in the radial direction, the mating terminal 200 would not be obstructed from being smoothly inserted into the electrical connector 100. In an exemplary embodiment of the disclosure, the outer through hole 15 and the inner through hole 23 are formed between both ends of each of the outer housing 1 and the inner housing 2 respectively, so as to allow the mating terminal 200 to be inserted into and pass through the electrical connector 100 in the axial direction as shown in FIG. 2.

In an exemplary embodiment of the disclosure, an elastic reset mechanism is provided between the mounting portion 24 of the inner housing 2 and the outer housing 1. The inner housing 2 is movable relative to the outer housing 1 against an elastic force of the elastic reset mechanism in the radial direction. After a radial external force exerted on the inner housing 2 is removed, the elastic mechanism 4 may drive the inner housing 2 to return back to the initial position.

In an exemplary embodiment of the disclosure, as shown in FIGS. 14 to 19, an electrical connector 100' is adapted to be electrically connected to a plug-type mating terminal 200, and includes an outer housing 1', an inner housing 2', and an elastic terminal 3. The outer housing 1' includes an outer cylinder 11', and an upper blocking disc 12 and a lower blocking disc 14' radially inwardly extending from both ends of the outer cylinder 11'. The upper blocking disc 12 is formed with an outer through hole 15. The inner housing 2' includes an inner cylinder 21' and a mounting portion 24' surrounding the inner cylinder 21' and integrally formed around the inner cylinder 21'. The mounting portion 24' is movably mounted in a space defined by the outer cylinder 11', the upper blocking disc 12, and the lower blocking disc 14'. Further, the inner housing 2' is formed with an inner through hole 23. The elastic terminal 3 is mounted in the inner cylinder 21' and is configured to be electrically connected with the mating terminal 200 inserted into the inner cylinder 21' through the outer through hole 15 of the outer housing 1'.

Figure 15:
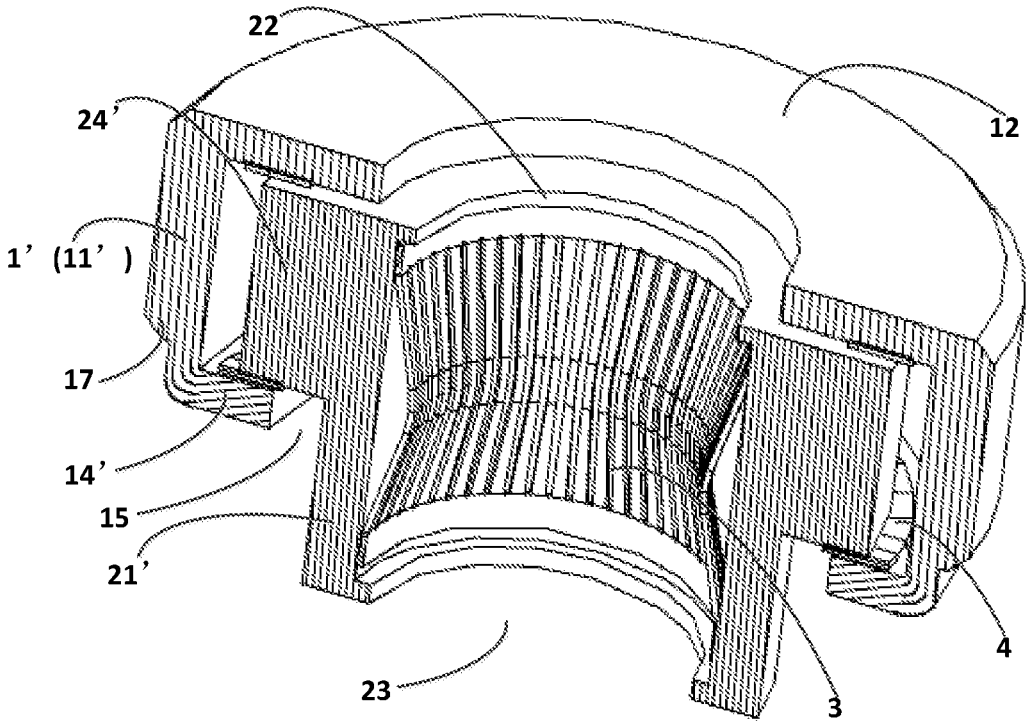
FIG. 15 is a sectional perspective view of the electrical connector of FIG. 14.

The electrical connector 100' according to an exemplary embodiment of the disclosure further includes an elastic mechanism 4 mounted between the outer housing 1' and the inner housing 2', as shown in FIG. 15. The inner housing 2' is movable relative to the outer housing 1' against an elastic force of the elastic mechanism 4. Since the inner housing 2' is movable relative to the outer housing 1' against the elastic force of the elastic mechanism 4, the mating terminal 200 mounted in the elastic terminal 3 is allowed to move relative to the outer housing 1' together with the elastic terminal 3 to realize a floating electrical connection between the mating terminal 200 and the electrical connector 100'.

As shown in FIGS. 14 to 19, in an exemplary embodiment of the disclosure, the lower blocking disc 14' is formed by bending inwardly radially after the mounting portion 24' of the inner housing 2' and the elastic mechanism 4 are assembled into the outer housing 1'. In this way, a holding force of the lower blocking disc 14' to the inner housing 2' may be increased, and an overall structure of the electrical connector may be simplified. In addition, the upper blocking disc 12 and the outer cylinder 11' may be manufactured at one time through a stamping process, for example.

In an exemplary embodiment of the disclosure, the electrical connector 100' may comprise a circular connector and have a generally cylindrical outer profile. Each of the outer housing 1', the elastic terminal 3, the inner housing 2' and the elastic mechanism 4 is made of a conductive material such as copper, such that the mating terminal 200 is in electrical communication with the outer housing 1'. In this way, the outer housing 1' may be directly electrically connected onto a circuit board 300 to realize an electrical connection between the mating terminal 200 and the circuit board 300.

It should be appreciated that the elastic terminal 3 and the elastic mechanism 4 of the electrical connector 100' shown in FIGS. 14 to 19 may be configured as the elastic terminal 3 and the elastic mechanism 4 of the electrical connector 100 shown in FIGS. 1 to 11.

In an exemplary embodiment of the disclosure, the mounting portion 24' has a height less than that of the inner cylinder 21', such that at least one portion of the inner cylinder 21' protrudes from at least one of the upper blocking disc 12 and the lower blocking disc 14' of the outer housing 1'. In an exemplary embodiment of the disclosure, the mounting portion 24' is formed at a position close to the upper blocking disc 12, and the at least one portion of the inner cylinder 21' protrudes from the lower blocking disc 14'. That is, as shown in FIG. 15, the mounting portion 24' protrudes radially outwardly from an end of the inner cylinder 21' close to the lower blocking disc 14' to form an annular flange. In an alternative embodiment, the mounting portion 24' may be composed of a plurality of protrusions located at the same level.

Figure 16:
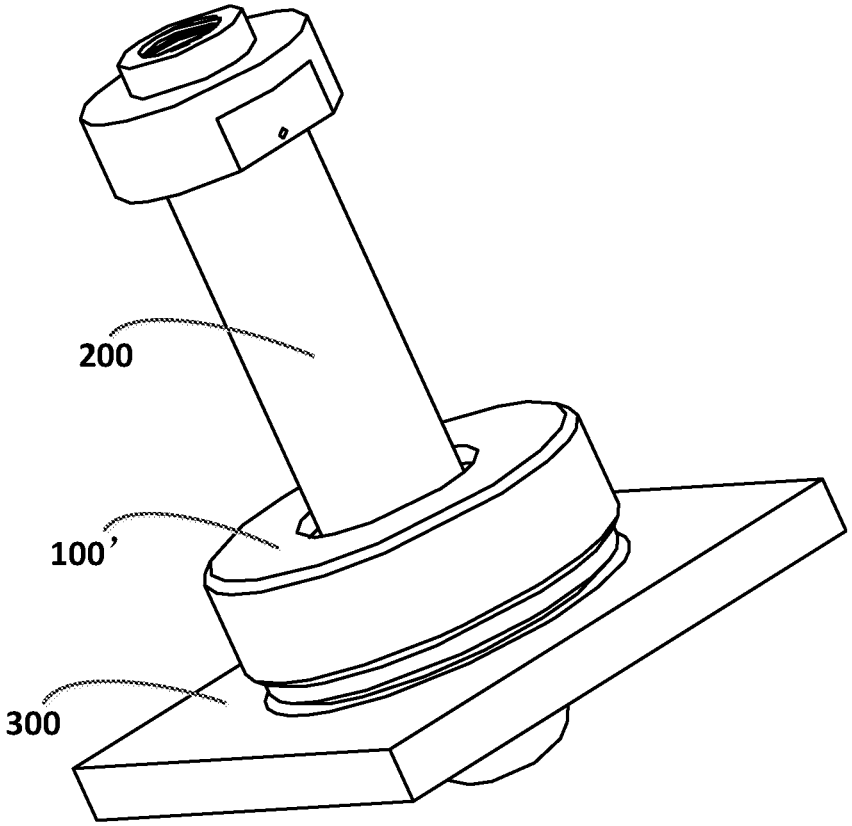
FIG. 16 is a perspective view of the electrical connector of FIG. 14 connected with a mating terminal.

In an exemplary embodiment of the disclosure, a portion of the outer cylinder 11' close to an end of the outer cylinder 11' proximate to the lower blocking disc 14' is formed as a stepped portion 17, as shown in FIGS. 18 to 21, which is configured to mount the outer housing 1' into a mounting hole of the circuit board 300. The circuit board 300 formed with the mounting hole or a copper terminal block may be mounted on the stepped portion 17 through a welding or crimping process and abutted against a radially extending portion of the stepped portion 17, so that the electrical connector 100' is firmly mounted on the circuit board 300 as shown in FIG. 16. Further, a serration portion is formed on an axially extending portion of the stepped portion 17 such that the electrical connector 100' is further firmly mounted on the circuit board 300. In this way, the inner cylinder 21" of the electrical connector 100" passes through the circuit board 300, which may reduce an overall height of an electronic device including the circuit board 300 and the electrical connector 100.

Figure 10:
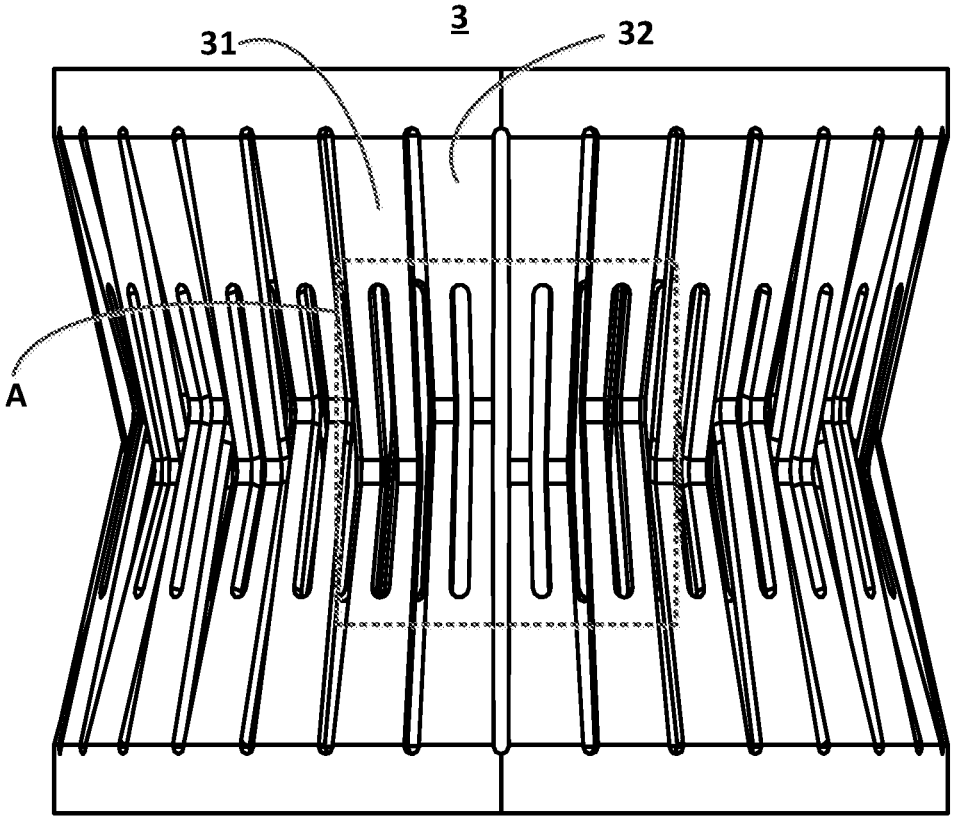
FIG. 10 is a front view of the elastic terminal of FIG. 7.

In an exemplary embodiment of the disclosure, an inner diameter of the inner through hole 23 is less than that of the outer through hole 15, and the inner through hole 23 is located in the outer through hole 15 in a state where the inner cylinder 21' occurs a maximum floating relative to the outer housing 1' in a radial direction. In this way, even in the case where the inner cylinder 21' occurs the maximum floating relative to the outer housing 1' in the radial direction, the mating terminal 200 would not be obstructed from being smoothly inserted into the electrical connector 100'. In an exemplary embodiment of the disclosure, the outer through hole 15 and the inner through hole 23 are formed between both ends of each of the outer housing 1' and the inner housing 2', respectively, so as to allow the mating terminal 200 to be inserted into and pass through the electrical connector 100' in an axial direction as shown in FIG. 10.

Figure 20:
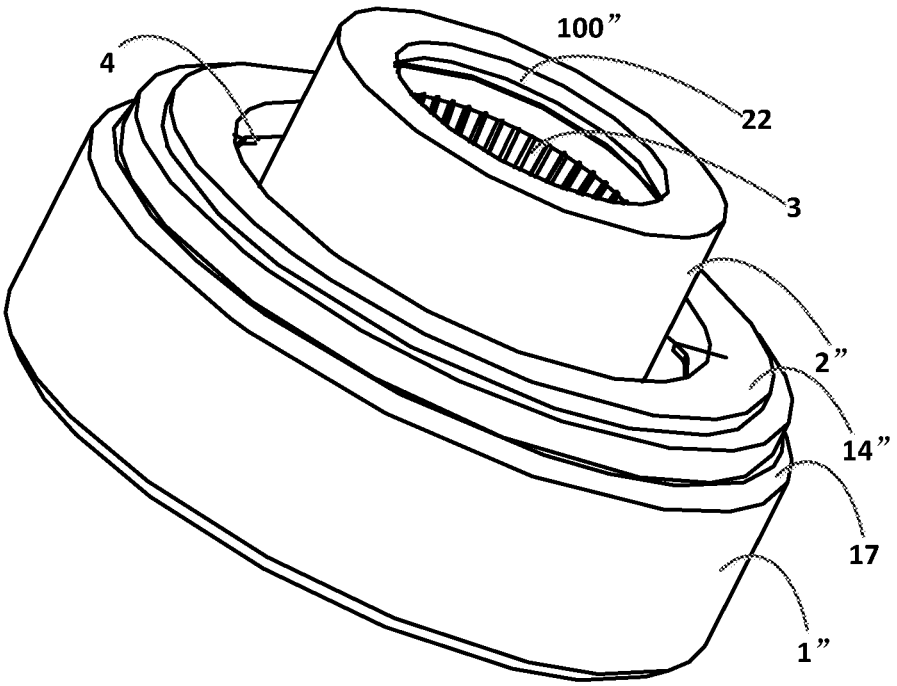
FIG. 20 is a perspective view of an electrical connector according to another embodiment.
Figure 21:
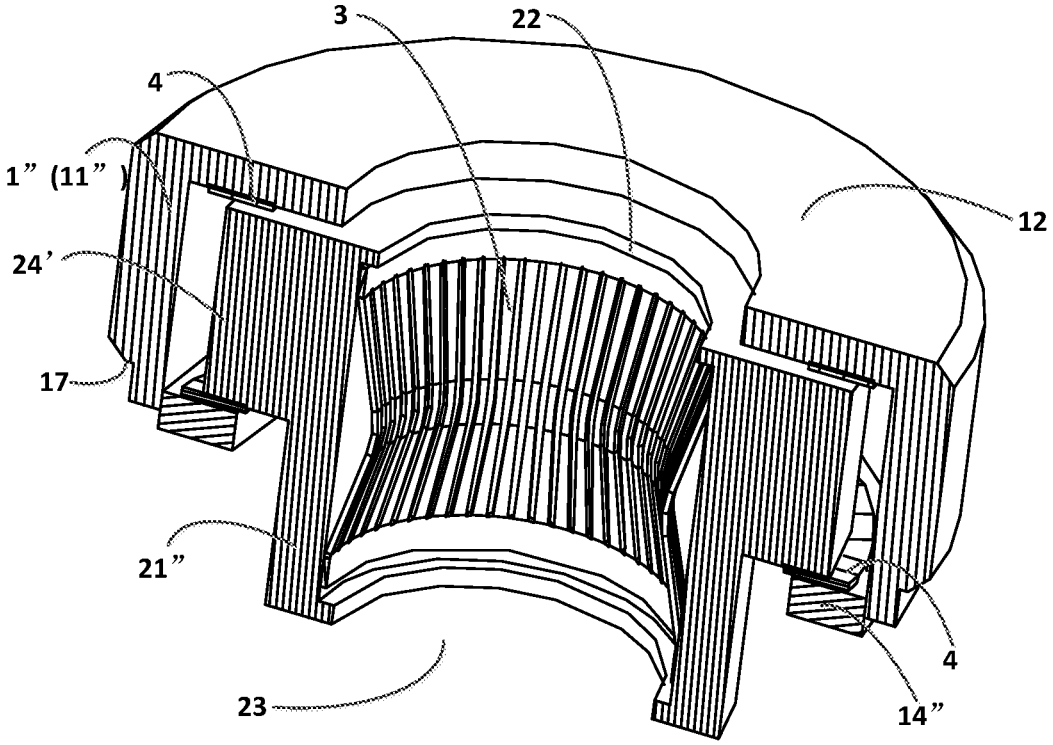
FIG. 21 is a sectional perspective view of the electrical connector of FIG. 20.
Figure 22:
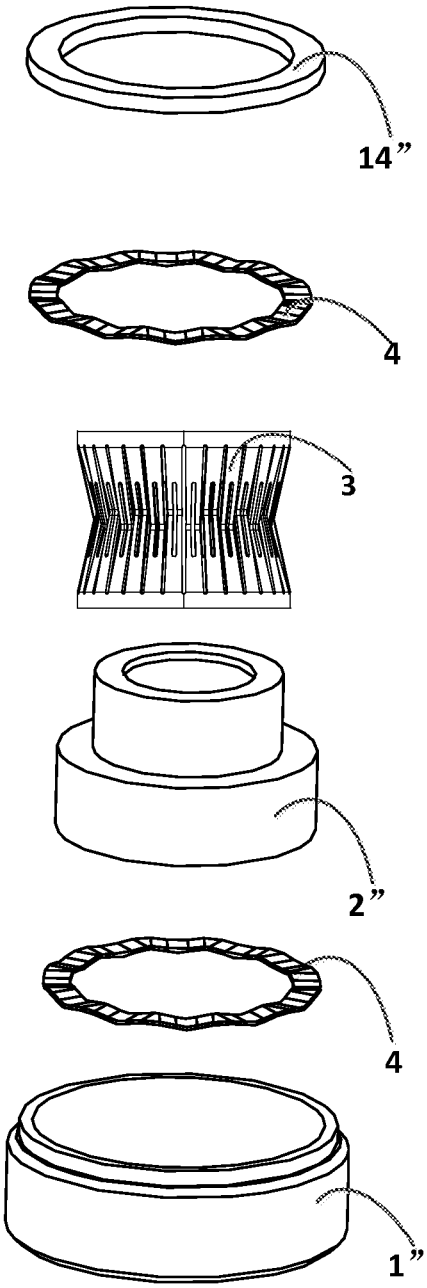
FIG. 22 is an exploded perspective view of the electrical connector of FIG. 21.

In an exemplary embodiment of the disclosure, as shown in FIGS. 20 to 22, an electrical connector 100" is adapted to be electrically connected to a plug-type mating terminal 200, and includes an outer housing 1", an inner housing 2" and an elastic terminal 3. The outer housing 1" includes an outer cylinder 11", and an upper blocking disc 12 and a lower blocking disc 14" radially inwardly extending from both ends of the outer cylinder 11". The upper blocking disc 12 is formed with an outer through hole 15. The inner housing 2" includes an inner cylinder 21" and a mounting portion 24' surrounding the inner cylinder 21" and integrally formed around the inner cylinder 21". The mounting portion 24' is movably mounted in a space defined by the outer cylinder 11", the upper blocking disc 12 and the lower blocking disc 14". Further, the inner housing 2" is formed with an inner through hole 23. The elastic terminal 3 is mounted in the inner cylinder 21" and is configured to be electrically connected with the mating terminal 200 inserted into the inner cylinder 21" through the outer through hole 15 of the outer housing 1".

The electrical connector 100" according to an exemplary embodiment of the disclosure further includes an elastic mechanism 4 mounted between the outer housing 1" and the inner housing 2". The inner housing 2" is movable relative to the outer housing 1" against an elastic force of the elastic mechanism 4. Since the inner housing 2" is movable relative to the outer housing 1" against the elastic force of the elastic mechanism 4, the mating terminal 200 mounted in the elastic terminal 3 is allowed to move relative to the outer housing 1" together with the elastic terminal 3 to realize a floating electrical connection between the mating terminal 200 and the electrical connector 100".

In an exemplary embodiment of the disclosure, the lower blocking disc 14" shown in FIGS. 21 and 22 is assembled into a lower end of the outer cylinder 11" after the inner housing 21" and the elastic mechanism 4 are assembled into the lower end of the outer housing 1". For example, the lower blocking disc 14" may be assembled into the outer cylinder 11" by a thread connection, a snap connection, a welding connection or any combination thereof.

In an exemplary embodiment of the disclosure, a portion of the outer cylinder 11" close to the lower end thereof proximate to the lower blocking disc 14" is formed as a stepped portion 17 configured to mount the outer housing 1" into a mounting hole of the circuit board 300. The circuit board 300 formed with the mounting hole or a copper terminal block may be mounted on the stepped portion 17 through a welding or crimping process and abutted against a radially extending portion of the stepped portion 17, so that the electrical connector 100" is firmly mounted on the circuit board. Further, a serration portion is formed on an axially extending portion of the stepped portion 17 such that the electrical connector 100" is further firmly mounted on the circuit board 300.

Figure 14:
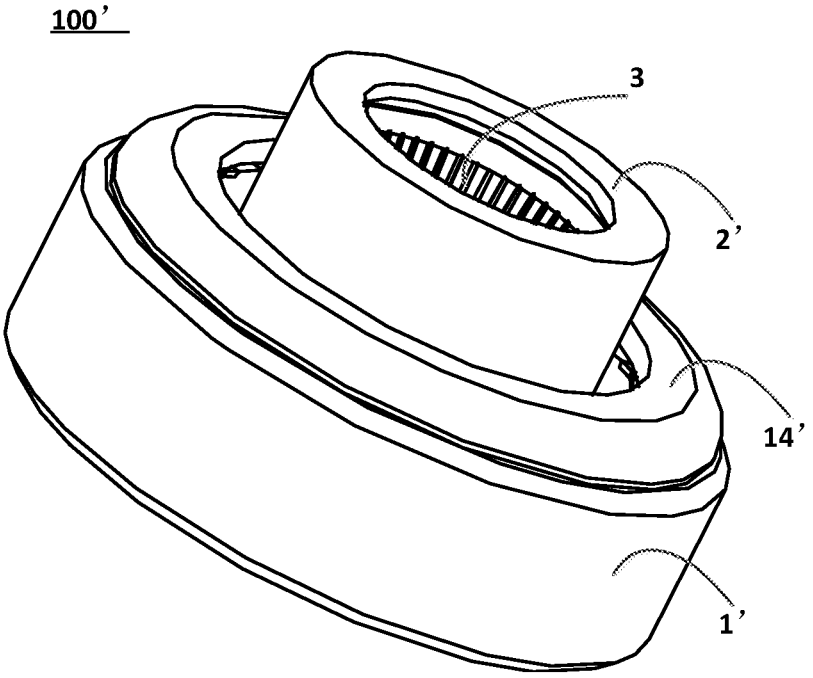
FIG. 14 is a perspective view of an electrical connector according to another embodiment.

It should be understood that the electrical connector 100" shown in FIGS. 14 to 16 is different from that shown in FIGS. 8 to 13 only in the lower blocking disc 14', 14", and the elastic terminal and the elastic mechanism of the electrical connector 100" shown in FIGS. 20 to 22 may be configured as the elastic terminal 3 and the elastic mechanism 4 of the electrical connector 100 shown in FIGS. 1 to 11.

Figure 23:
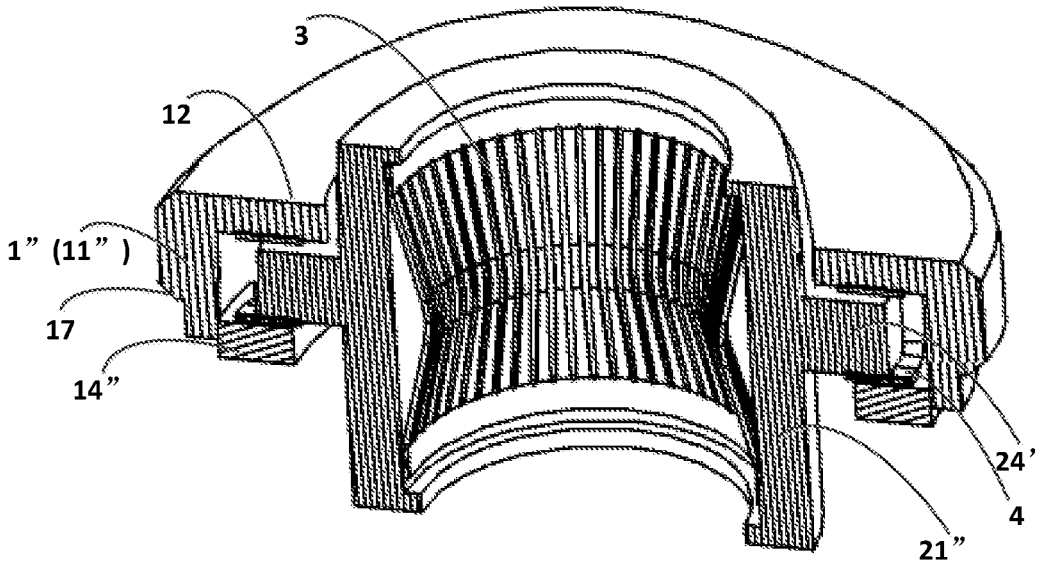
FIG. 23 is a sectional perspective view of an electrical connector according to another embodiment.

An electrical connector according to another embodiment shown in FIG. 23 is a modification of the electrical connector shown in FIGS. 14 to 16. As shown in FIG. 23, the inner housing includes an inner cylinder 21" and a mounting portion 24" surrounding the inner cylinder 21" and integrally formed around the inner cylinder 21'. The mounting portion 24" is movably mounted in a space defined by an outer cylinder 11", and an upper blocking disc 12 and a lower blocking disc 14" of the outer housing 1". Further, the inner housing is formed with an inner through hole. The elastic terminal 3 is mounted in the inner cylinder 21" and is configured to be electrically connected with the mating terminal 200 inserted into the inner cylinder 21" through the outer through hole of the outer housing 1". The mounting portion 24" is formed between the upper blocking disc 12 and the lower blocking disc 14", and an upper portion and a lower portion of the inner cylinder 21" protrude from the upper blocking disc 12 and the lower blocking disc 14", respectively.

Figure 17:
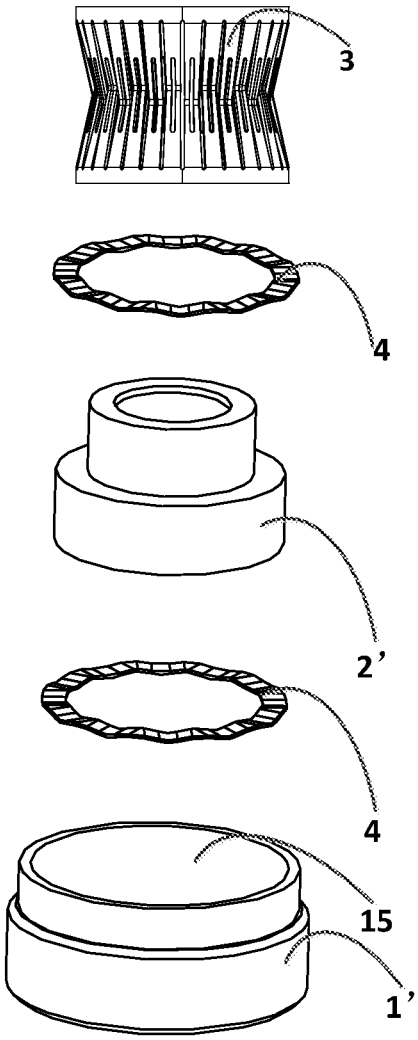
FIG. 17 is an exploded perspective view of the electrical connector of FIG. 14.
Figure 18:
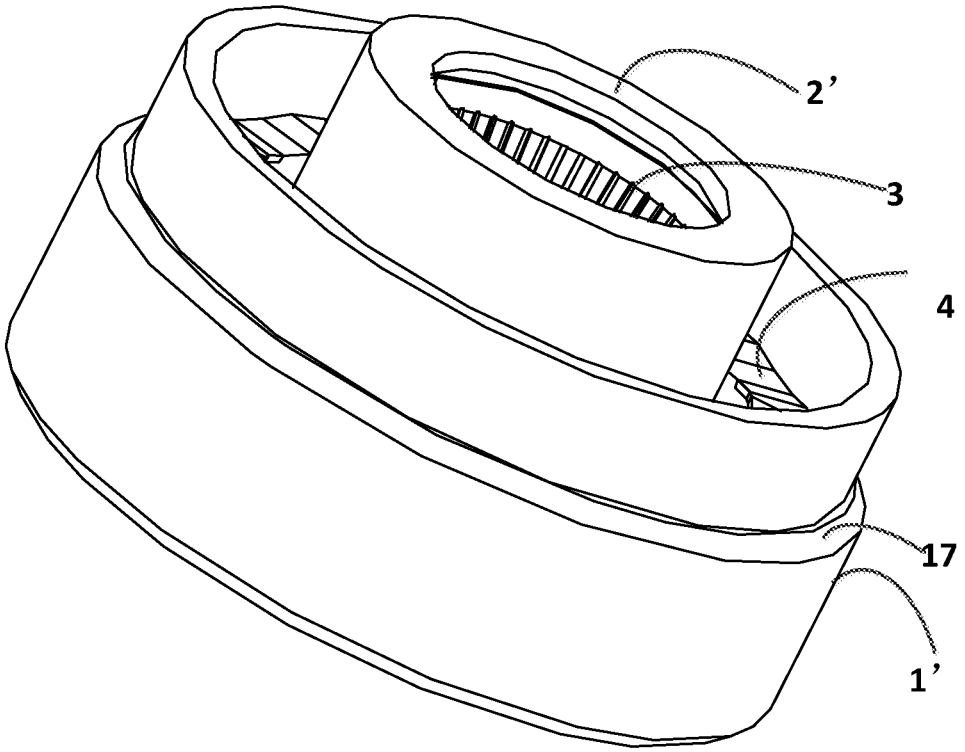
FIG. 18 is a perspective view of the electrical connector of FIG. 14 in a state in which a lower blocking disc of an outer housing is not bent.
Figure 19:
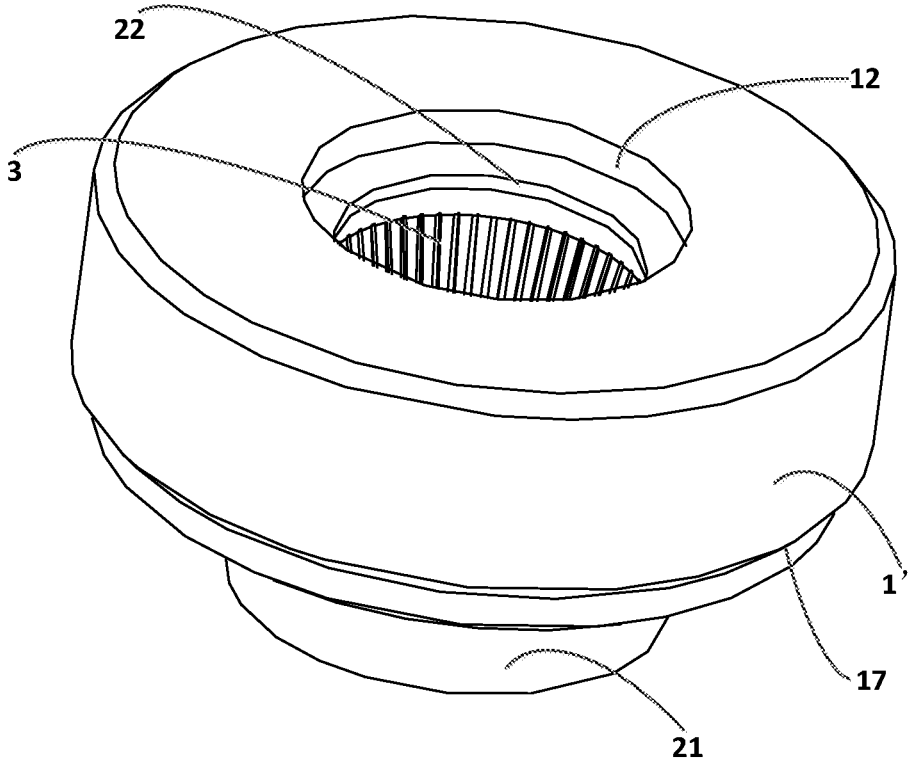
FIG. 19 is another perspective view of the electrical connector of FIG. 14.

In an exemplary embodiment of the disclosure, a portion of the outer cylinder 11" close to an end of the outer cylinder 11" proximate to the lower blocking disc 14" is formed as a stepped portion 17 which is configured to mount the outer housing 1" into a mounting hole of the circuit board 300. The circuit board 300 formed with the mounting hole or a copper terminal block may be mounted on the stepped portion 17 through a welding or crimping process and abutted against a radially extending portion of the stepped portion 17, so that the electrical connector as shown in FIG. 17 is firmly mounted on the circuit board 300. Further, a serration portion is formed on an axially extending portion of the stepped portion 17 such that the electrical connector is further firmly mounted on the circuit board. In this way, the inner cylinder 21" of the electrical connector passes through the circuit board 300, which may reduce an overall height of an electronic device including the circuit board 300 and the electrical connector.

According to another embodiment of the disclosure, as shown in FIGS. 2 and 16, there is provided an electronic device including the electrical connectors 100, 100', 100" described in any of the above embodiments and a circuit board 300 to which the electrical connector 100, 100', 100" is electrically connected. Further, the outer cylinder of the electrical connector 100, 100', 100" passes through a mounting hole of the circuit board 300 and is electrically connected with the circuit board 300. In an alternative embodiment, an end surface of the upper blocking disc 12 or the lower blocking disc 14 of the electrical connector 100, 100', 100" may be welded to the circuit board 300.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle.

Although the disclosure has been described hereinbefore in detail with reference to the attached drawings, it should be appreciated that the disclosed embodiments in the attached drawings are intended to illustrate the embodiments of the disclosure by way of example, and should not be construed as a limitation to the disclosure.

Although a few embodiments of the general inventive concept of the disclosure have been shown and described, it would be appreciated by those skilled in the art that changes or modification may be made to these embodiments without departing from the principles and spirit of the general inventive concept, the scope of which is defined in claims and their equivalents.

It should be noted that, the word "include" doesn't exclude other elements or steps, and the word "a" or "an" doesn't exclude more than one. In addition, any reference numerals in the claims should not be interpreted as the limitation to the scope of the disclosure.

What is claimed is:

1. An elastic terminal, comprising:

a first base having an annular shape;

a plurality of elastic sheets extending from the first base in an axial direction, a slit formed between a pair of adjacent elastic sheets, the plurality of elastic sheets including a plurality of sets of elastic sheets, each elastic sheet of each set of elastic sheets has a plurality of electrical contact portions protruding inwardly radially, the electrical contact portions of one set of elastic sheets are arranged on a same circumference and the electrical contact portions of different sets of elastic sheets are staggered with respect to each other in the axial direction; and an annular second base to which an end of each elastic sheet opposite to the first base is integrally connected, each elastic sheet of each set of elastic sheets extends continuously from the first base to the annular second base.

2. The elastic terminal of claim 1, wherein the plurality of sets of elastic sheets include a plurality of first elastic sheets and a plurality of second elastic sheets alternately arranged in a circumferential direction.

3. The elastic terminal of claim 2, wherein the plurality of first elastic sheets include a plurality of first electrical contact portions and the plurality of second elastic sheets include a plurality of second electrical contact portion, a circumference on which the first electrical contact portions of the plurality of first elastic sheets are arranged is symmetrical with a circumference on which the second electrical contact portions of the plurality of second elastic sheets are arranged with respect to a middle cross sectional plane of the elastic sheets in the axial direction.

4. The elastic terminal of claim 1, wherein each of the elastic sheets has a slot extending in the axial direction, the electrical contact portions are located at a pair of sides of the slot.

5. The elastic terminal of claim 1, wherein the elastic terminal is formed through a crimping process, a gap is formed between a pair of edges of the elastic terminal to be crimped when the elastic terminal is in a free state.

6. The elastic terminal of claim 1, wherein each of the electrical contact portions is formed as a vertex portion when each elastic sheet is bent inwardly radially.

7. The elastic terminal of claim 1, wherein each of the electrical contact portions has a generally arc-shaped contact surface protruding inwardly radially.

8. The elastic terminal of claim 1, wherein the circumferences where the electrical contact portions of all of the elastic sheets are arranged have a substantially same inner diameter.

9. A method for manufacturing an elastic terminal, comprising:

stamping a plurality of elastic sheets extending in parallel in a first direction from a single flat metal sheet, an end of each elastic sheet connected to a first base and a slit formed between a pair of adjacent elastic sheets, another end of each elastic sheet opposite to the first base is connected to a second base and each elastic sheet extends continuously from the first base to the second base in the first direction;

dividing the elastic sheets into a plurality of sets of elastic sheets and forming a plurality of electrical contact portions on each elastic sheet of each set of elastic sheets, the electrical contact portions of one set of elastic sheets are arranged in a row in a second direction perpendicular to the first direction and the electrical contact portions of different sets of elastic sheets are staggered with respect to each other in the first direction;

bending each of the elastic sheets at each electrical contact portion in a third direction perpendicular to the first direction and the second direction; and bending the first base into a generally annular shape, the electrical contact portions of each set of elastic sheets are arranged on a same circumference and protrude inwardly radially.

10. The method of claim 9, wherein the plurality of sets of elastic sheets include a plurality of first elastic sheets and a plurality of second elastic sheets arranged alternately in a circumferential direction of the elastic terminal.

11. The method of claim 10, wherein the electrical contact portions each have a generally arc-shaped contact surface and are formed in the dividing step through a stamping process.

12. The method of claim 11, wherein the single flat metal sheet is made of a copper-nickel material and, after forming the electrical contact portions, an electroplating layer is electroplated on a surface of the elastic terminal, the electroplating layer has an electrical conductivity greater than the single flat metal sheet.

13. The method of claim 12, wherein the electroplating layer includes a beryllium copper material.

14. The method of claim 10, wherein the plurality of first elastic sheets includes a plurality of first electrical contact portions and the plurality of second elastic sheets includes a plurality of second electrical contact portions, each of the first electrical contact portions of the plurality of first elastic sheets is offset from a center line of the respective first elastic sheet in the second direction by a same distance as each of the second electrical contact portions of the plurality of second elastic sheets.

15. The method of claim 9, wherein the stamping step includes forming a slot extending in each of the elastic sheets in the first direction.

16. The method of claim 9, wherein in the step of bending the first base, a gap is formed between a pair of edges of the elastic terminal to be crimped after bending the first base into the generally annular shape.

17. An electrical connector adapted to be electrically connected with a mating terminal, comprising:

an outer housing including an outer cylinder, and an upper blocking disc and a lower blocking disc radially inwardly extending from a pair of ends of the outer cylinder, the upper blocking disc having an outer through hole;

an inner housing including an inner cylinder and a mounting portion surrounding the inner cylinder and integrally formed around the inner cylinder, the mounting portion being movably mounted in a space defined by the outer cylinder, the upper blocking disc, and the lower blocking disc, the inner housing having an inner through hole; and an elastic terminal mounted in the inner cylinder and electrically connected with the mating terminal inserted into the inner cylinder through the outer through hole and the inner through hole, the elastic terminal including a first base having an annular shape and a plurality of elastic sheets extending from the first base in an axial direction, a slit formed between a pair of adjacent elastic sheets, the plurality of elastic sheets including a plurality of sets of elastic sheets, each elastic sheet of each set of elastic sheets has a plurality of electrical contact portions protruding inwardly radially, the electrical contact portions of one set of elastic sheets are arranged on a same circumference and the electrical contact portions of different sets of elastic sheets are staggered with respect to each other in the axial direction.

18. An electronic device, comprising:

an electrical connector adapted to be electrically connected with a mating terminal, including:

an outer housing including an outer cylinder, and an upper blocking disc and a lower blocking disc radially inwardly extending from a pair of ends of the outer cylinder, the upper blocking disc having an outer through hole;

an inner housing including an inner cylinder and a mounting portion surrounding the inner cylinder and integrally formed around the inner cylinder, the mounting portion being movably mounted in a space defined by the outer cylinder, the upper blocking disc, and the lower blocking disc, the inner housing having an inner through hole; and an elastic terminal mounted in the inner cylinder and electrically connected with the mating terminal inserted into the inner cylinder through the outer through hole and the inner through hole, the elastic terminal including a first base having an annular shape and a plurality of elastic sheets extending from the first base in an axial direction, a slit formed between a pair of adjacent elastic sheets, the plurality of elastic sheets including a plurality of sets of elastic sheets, each elastic sheet of each set of elastic sheets has a plurality of electrical contact portions protruding inwardly radially, the electrical contact portions of one set of elastic sheets are arranged on a same circumference and the electrical contact portions of different sets of elastic sheets are staggered with respect to each other in the axial direction; and a circuit board to which the electrical connector is electrically connected.

* * * * *